United States Patent [19]

Lossa

[11] 3,939,633

[45] Feb. 24, 1976

[54] SPINDLE START CONTROL DEVICE FOR TEXTILE YARN PROCESSING MACHINE HAVING KNOTTING MECHANISM

[75] Inventor: Ulrich Lossa, Krefeld, Germany

[73] Assignee: Palitex Project Company GmbH, Germany

[22] Filed: Oct. 17, 1974

[21] Appl. No.: 515,694

[30] Foreign Application Priority Data

Oct. 17, 1973 Germany ..... 2352022

[52] U.S. Cl. ..... 57/34 R; 57/34.5; 57/58.7; 57/106; 242/35.5 R; 242/35.6 R

[51] Int. Cl.[2] ..... D01H 15/00

[58] Field of Search..... 57/34 R, 34.5, 58.7, 58.49, 57/58.87, 81, 88, 106, 80, 1 R, 54; 242/35.5 R, 35.6 R

[56] References Cited

UNITED STATES PATENTS

| | | | |
|---|---|---|---|
| 3,805,504 | 4/1974 | Franzen | 57/34 R |
| 3,805,507 | 4/1974 | Steppuhn | 57/81 |
| 3,820,315 | 6/1974 | Franzen et al. | 57/34 R |
| 3,842,577 | 10/1974 | Franzen | 57/34 R |
| 3,842,580 | 10/1974 | Franzen | 57/34 R |

*Primary Examiner*—John Petrakes
*Attorney, Agent, or Firm*—Parrott, Bell, Seltzer, Park & Gibson

[57] ABSTRACT

In a textile yarn processing machine, such as a twister, spinning frame or the like, having a plurality of spindle assemblies positioned in side-by-side relationship thereon for the processing of yarn, control devices operatively connected with each of the spindle assemblies for selectively stopping and starting operation of the respective spindle assemblies, and a yarn knotter mechanism for being selectively positioned in front of each spindle assembly in the event of a broken or otherwise separated yarn therein for knotting together the two ends of the separated yarn when the spindle is stopped by the control devices and including selectively actuatable mechanisms for operating the knotter mechanism for the knotting operation, the following improvement is provided. Mechanisms are operatively connected with the operating devices of the knotter mechanism and the spindle stopping and starting control mechanisms and are responsive to actuation of the operating devices of the knotter mechanism for actuating the control mechanisms to start operation of the spindle assembly for the processing of yarn, thereby reducing lost operating time due to the yarn separation.

7 Claims, 9 Drawing Figures

SPINDLE START CONTROL DEVICE FOR TEXTILE YARN PROCESSING MACHINE HAVING KNOTTING MECHANISM

BACKGROUND OF THE INVENTION

This invention relates to the improvement of means operatively connected with operating devices of a yarn knotter mechanism and spindle assembly stopping and starting control devices of a textile yarn processing machine and which are responsive to actuation of the operating devices of the knotter mechanism for actuating the control devices to start operation of the spindle assemblies for the processing of yarn, thereby reducing lost operating time due to the yarn separation.

In U.S. Pat. No. 3,820,315, issued June 28, 1974, and U.S. Pat. application Ser. No. 376,742, filed July 5, 1973, both of which are assigned to the assignee of the present invention, the improved combination of a textile yarn processing machine, such as a twister, spinning frame or the like, having a plurality of spindle assemblies positioned in side-by-side relationship for the processing of yarn and a manually operated portable yarn knotter mechanism for knotting together two ends of broken or otherwise separated yarn at selected spindle assembly locations with a holder device mounted stationary on the yarn processing machine in front of each spindle assembly for releasably receiving and mounting the yarn knotter mechanism for a yarn knotting operation at the selected spindle assembly, was set forth. These arrangements eliminated the previous conventional practice of an operator holding a portable yarn knotter mechanism and allowing the operator freedom for performing other tasks at the yarn processing machine. These previously set forth arrangements also included control means operatively connected with each of the spindle assemblies for selectively stopping and starting operation of the respective spindle assemblies and actuating means connected therewith and responsive to reception and mounting of the yarn knotter mechanism in the respective holders for actuating the control means to stop operation of the respective spindle assemblies for a yarn knotting operation.

It has also been proposed to provide the improved combination of a textile yarn processing machine, such as a twister, spinning frame or the like, having a plurality of spindle assemblies positioned in side-by-side relationship for the processing of yarn, control means for selectively stopping and starting operation of the respective spindle assemblies, a yarn knotter mechanism for knotting together two ends of broken or otherwise separated yarn at selected spindle assembly locations in the event of a broken or otherwise separated yarn and including selectively actuatable means for selectively operating yarn knotter mechanisms for the knotting operation, and a carriage movably mounted on the yarn processing machine in front of the spindle assemblies and carrying the yarn knotter mechanism for positioning of the yarn knotter mechanism in the desired knotting location in front of the selected spindle assembly for a yarn knotting operation when the spindle assembly is stopped by the control means. Examples of such arrangements are set forth in U.S. Pat. Nos. 3,842,577 and 3,842,580, both issued Oct. 22, 1974, and both of which are assigned to the assignee of the present invention. These arrangements also eliminate the previous conventional practice of an operator holding a portable yarn knotter mechanism and allowing the operator freedom for performing other tasks at the yarn processing machine.

However, with all of the above described arrangements, there is a considerable amount of lost operating time following the knotting operation and before the selected spindle assembly is again restarted by the control mechanism thereof. Accordingly, yarn production and processing time is lost and the machines are not operated as efficiently as possible.

BRIEF SUMMAY OF THE INVENTION

Accordingly, it is the object of this invention to eliminate or reduce the above described lost operating time inherent in the previously proposed, above described arrangements of yarn knotting mechanisms in textile yarn processing machines and to provide an improvement in such machines in which the spindle assemblies will be restarted as soon as possible.

It has been found by this invention that the above object may be accomplished by providing, in a textile yarn processing machine, such as a twister, spinning frame or the like, having a plurality of spindle assemblies positioned in side-by-side relationship thereon for processing of yarn, control means operatively connected with each of the spindle assemblies for selectively stopping and starting operation of the respective spindle assemblies, and a yarn knotter mechanism for being selectively positioned in front of each spindle assembly in the event of a broken or otherwise separated yarn therein for knotting together the two ends of the separated yarn when the spindle assembly is stopped by the control means and including selectively actuatable means for operating the knotter mechanism for the knotter operation, the following improvements. Means are operatively connected with the operating means of the knotter mechanism and with the spindle stopping and starting control means and are responsive to actuation of the operating means of the knotter mechanism for actuating the control means to start operation of the spindle assembly for the processing of yarn, thereby reducing lost operating time due to the yarn separation.

Specific features of the above improvement will be further set forth in the description of the preferred embodiments to follow.

BRIEF DESCRIPTION OF THE DRAWINGS

Some of the objects and advantages of this invention having been stated, other objects and advantages will appear as the description proceeds, when taken in conjunction with the accompanying drawings, in which.

DESCRIPTION OF PREFERRED EMBODIMENTS

Figure 1:
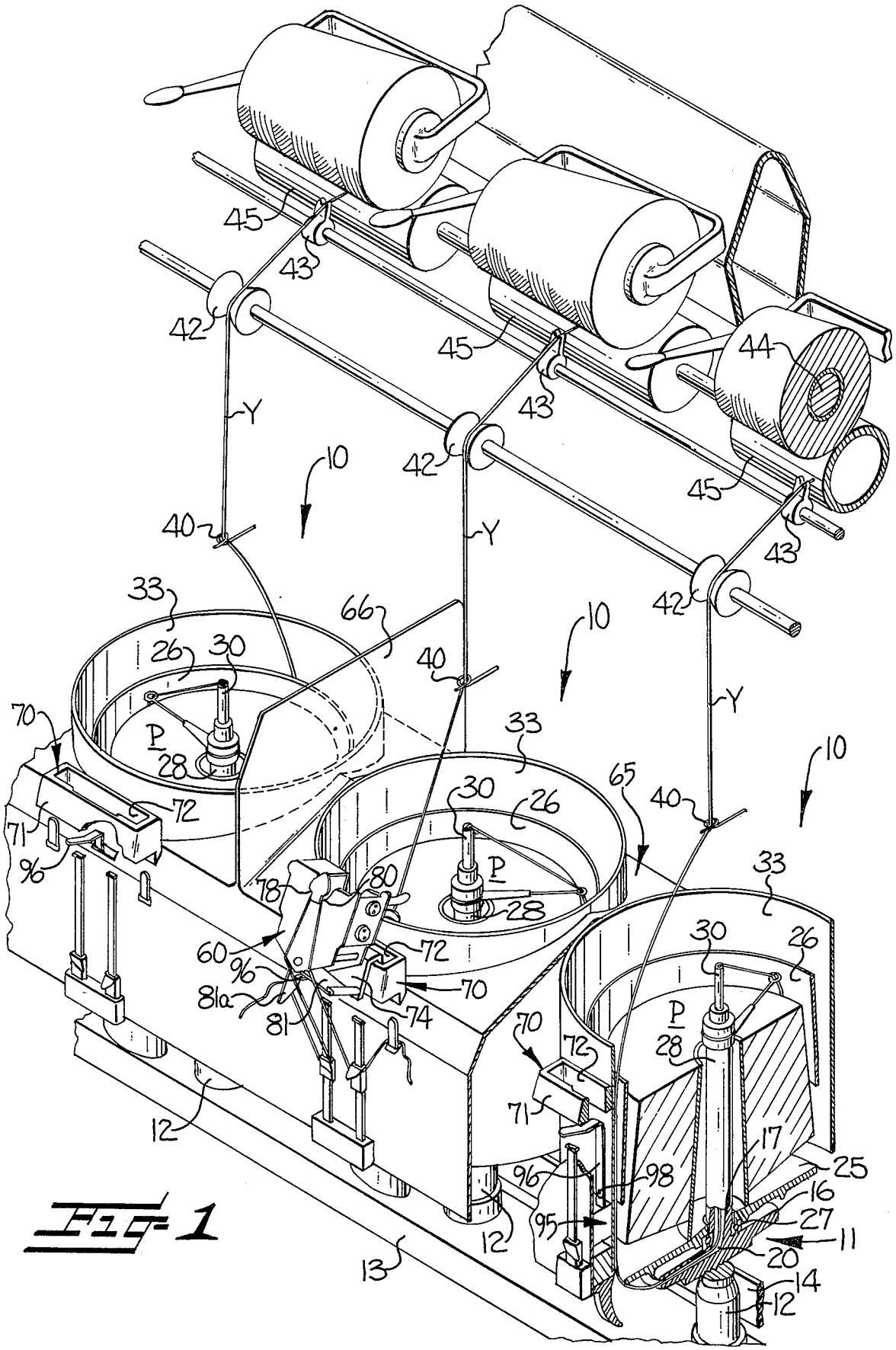
FIG. 1 is a perspective view of a first embodiment of this invention illustrating a portion of a two-for-one twister yarn processing machine showing two full spindle assembly stations and a cross-section through a third spindle assembly station with a yarn knotter mechanism inserted into a holder mechanism of the central spindle assembly station.
Figure 2:
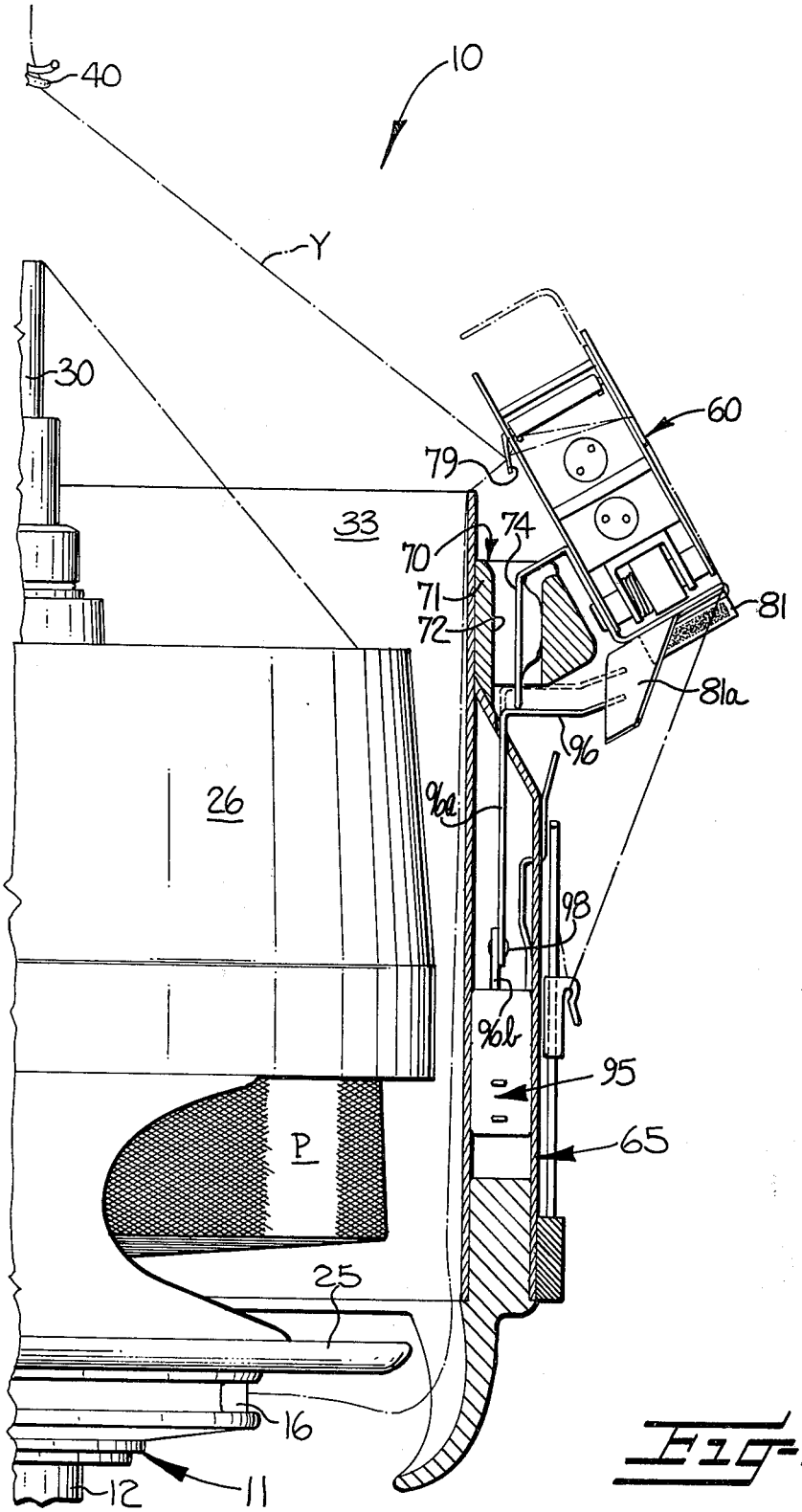
FIG. 2 is an enlarged, partial, vertical sectional view generally taken through the central spindle assembly of FIG. 1.
Figure 3:
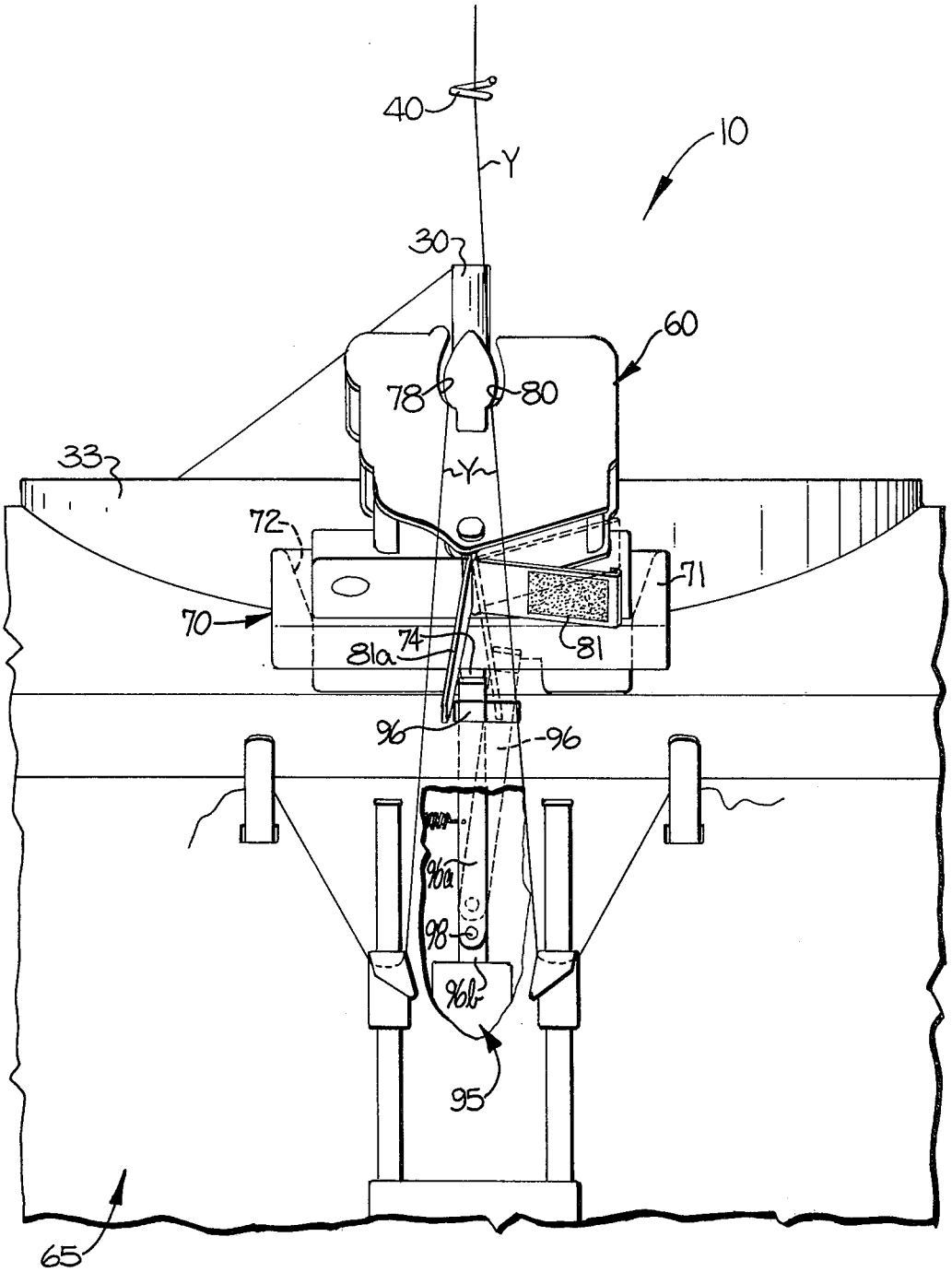
FIG. 3 is an enlarged, partial, front elevational view of the central spindle assembly of FIG. 1.
Figure 4:
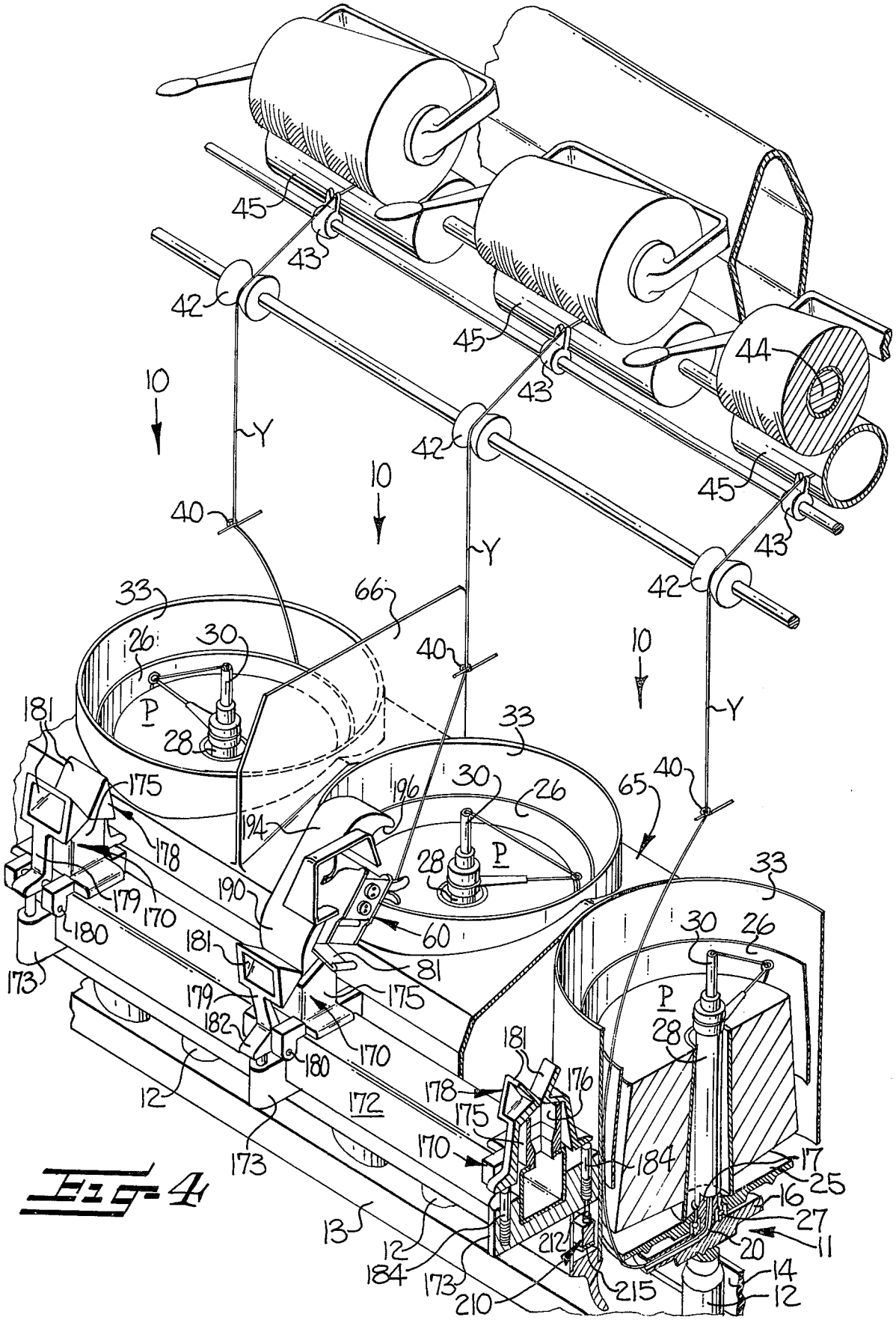
FIG. 4 is a perspective view of a second embodiment of this invention illustrating a portion of a two-for-one twister yarn processing machine showing two full spindle assembly stations and a cross-section through a third spindle assembly station with a yarn knotter mechanism inserted into a holder mechanism of the central spindle assembly station.
Figure 5:
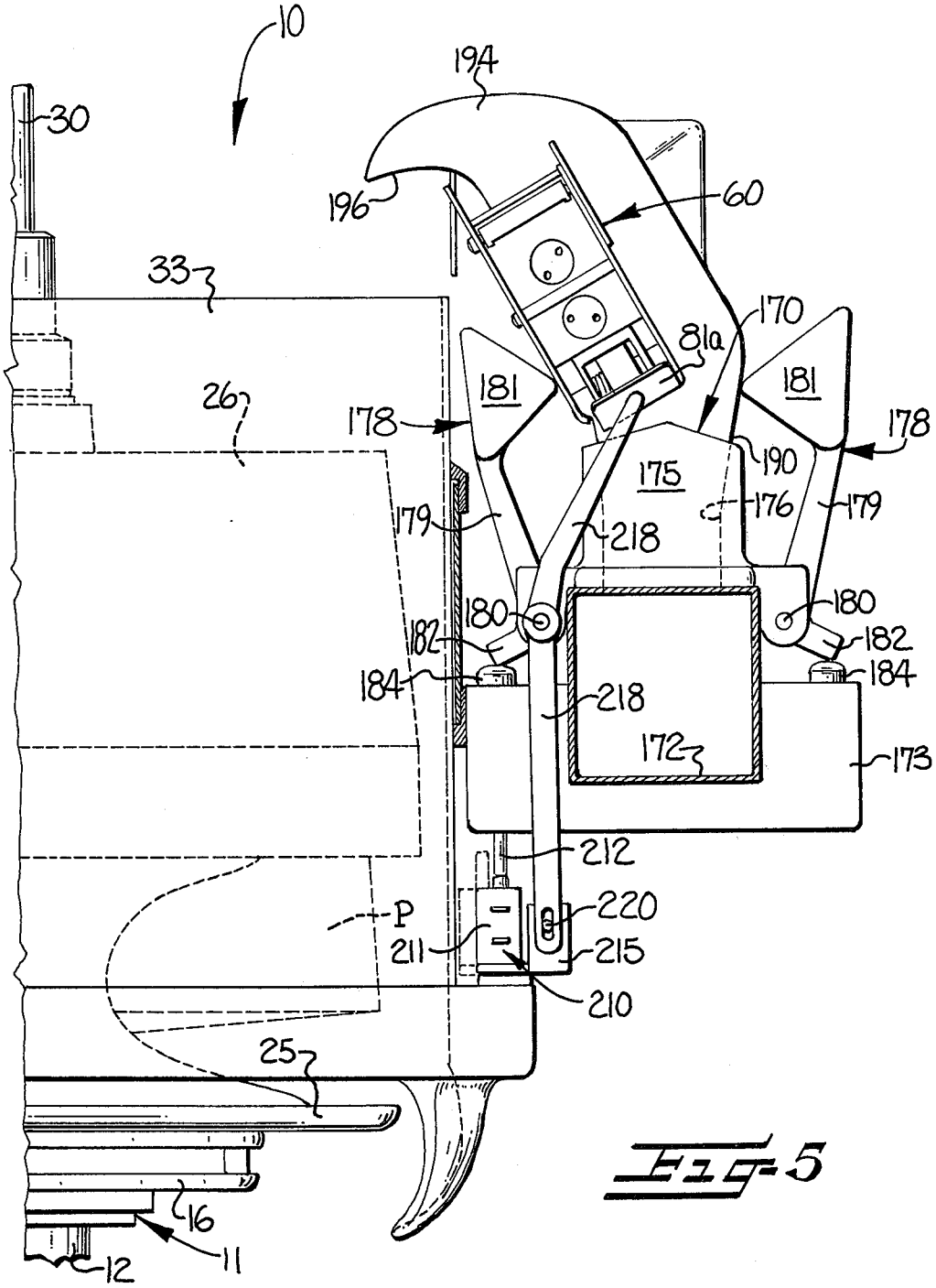
FIG. 5 is an enlarged, partial, vertical sectional view generally taken through the central spindle assembly of FIG. 4.
Figure 6:
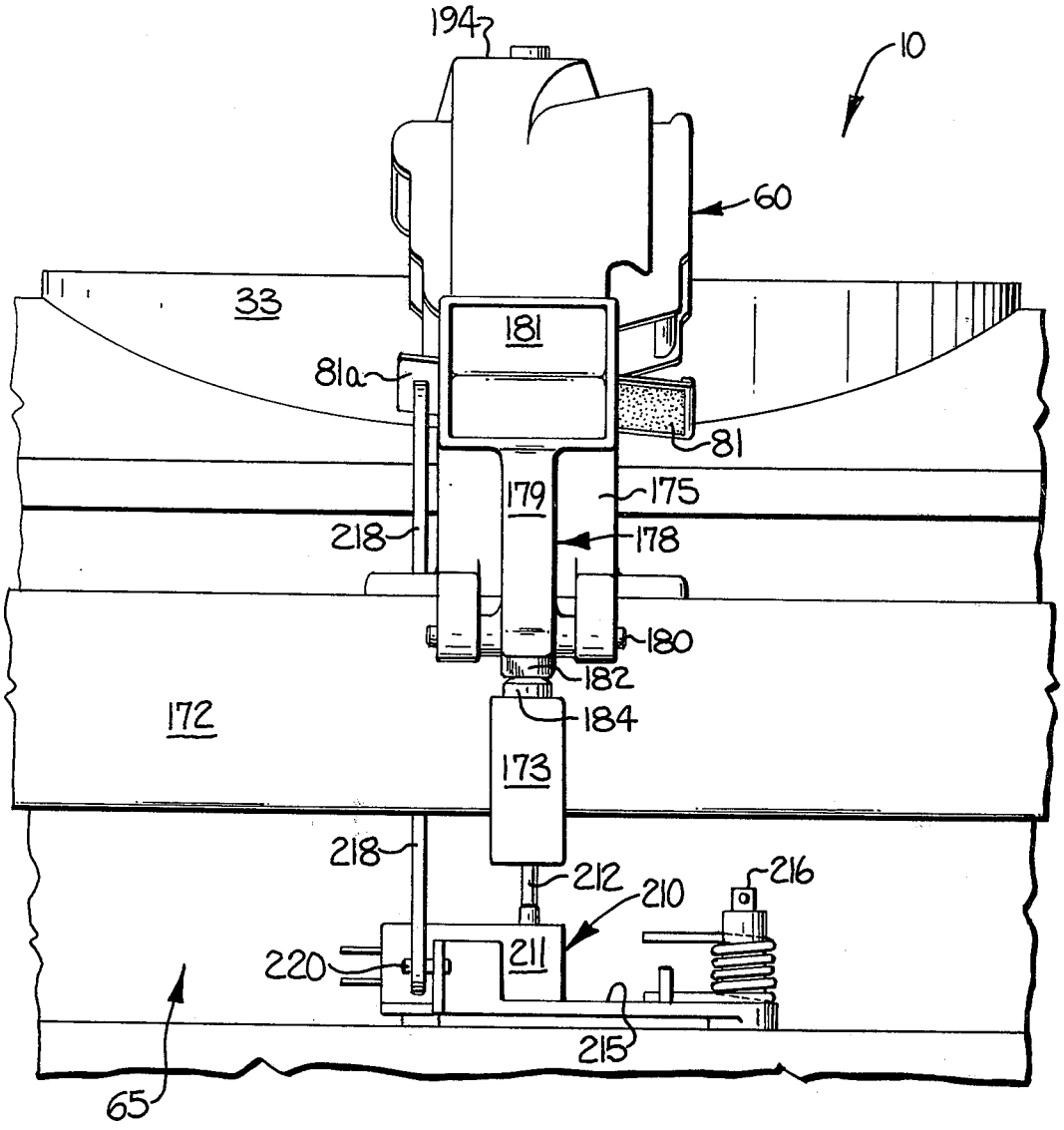
FIG. 6 is an enlarged, partial, front elevational view of the central spindle assembly of FIG. 4.
Figure 7:
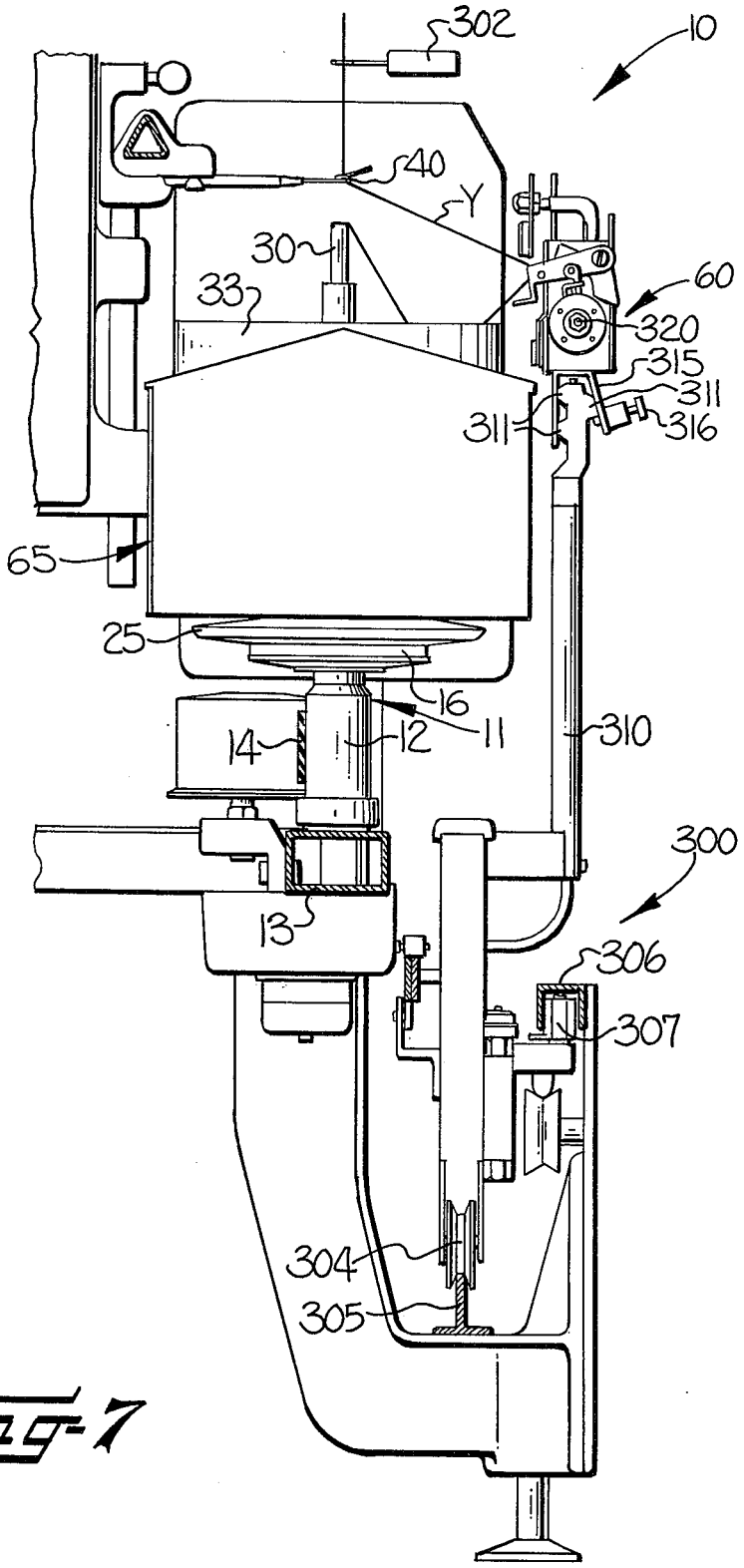
FIG. 7 is a partial, vertical sectional view taken generally through a spindle assembly of a third embodiment according to this invention.
Figure 8:
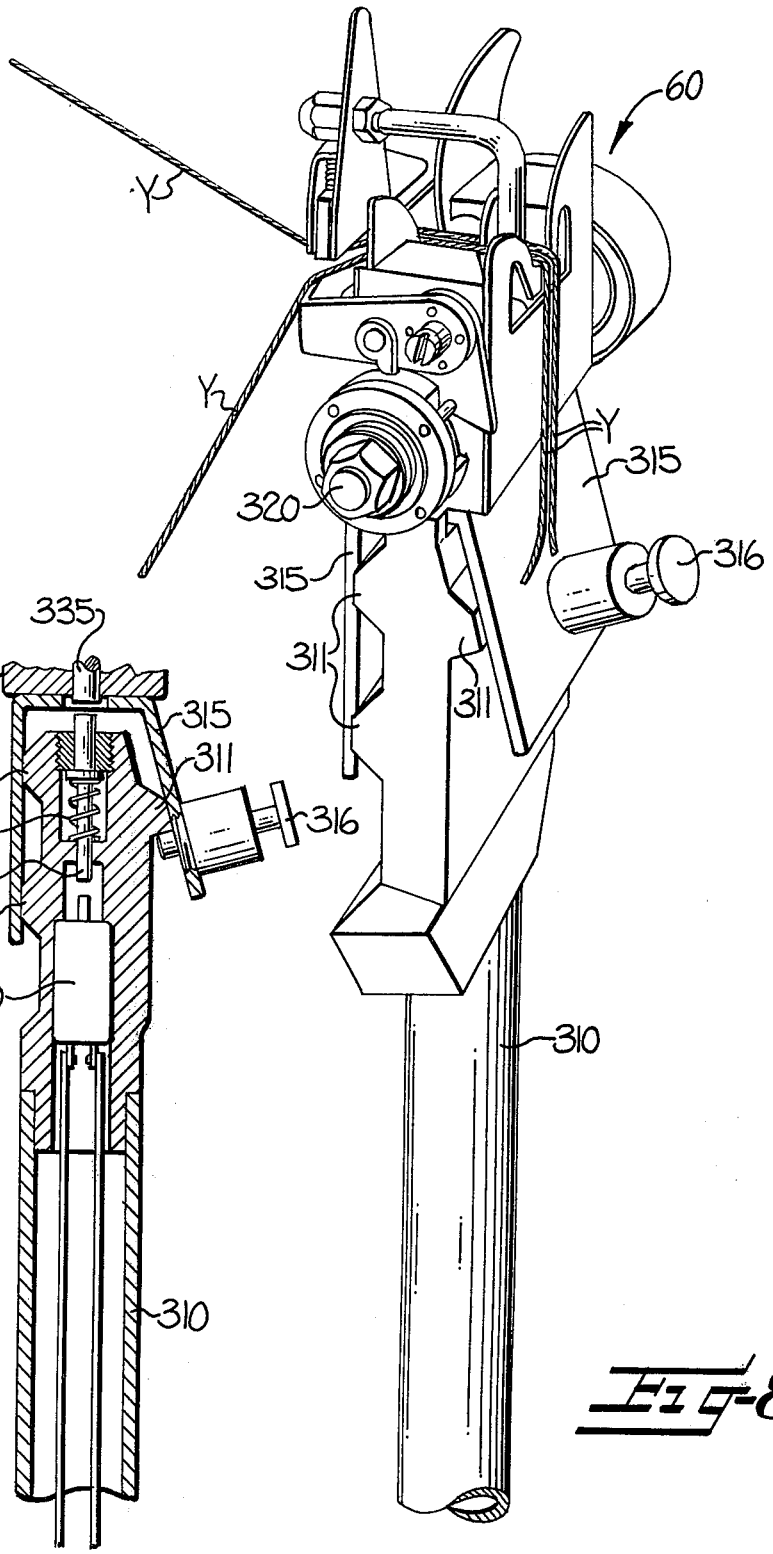
FIG. 8 is an enlarged perspective view of the knotting mechanism of FIG. 7 and illustrating the separated ends of yarn laid therein for a knotting operation.
Figure 9:
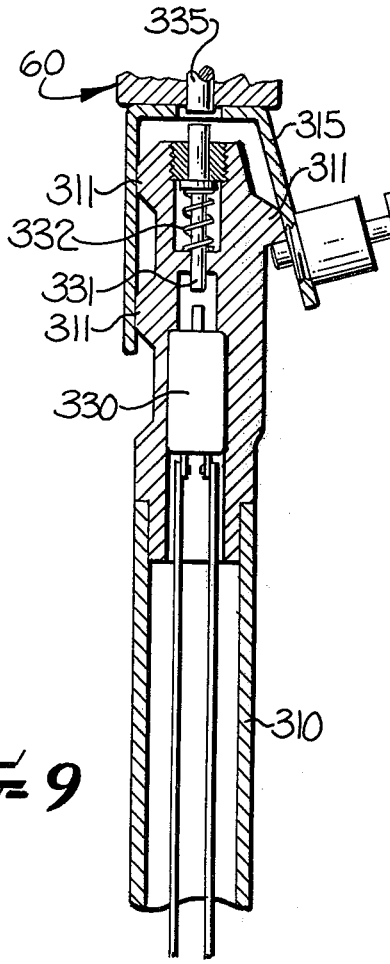
FIG. 9 is a partial cross-sectional view taken through a portion of the apparatus illustrated in FIG. 7.

Referring now to the drawings, there is shown in FIGS. 1–3 a first embodiment, in FIGS. 4–6 a second embodiment, and in FIGS. 7–9 a third embodiment in accordance with this invention. In all three of these embodiments, as set forth in the drawings and specific description to follow, the present invention will be described and related to a two-for-one twister which is the preferred yarn processing machine utilizing the improvements of this invention; however, it is to be understood that the improvements of this invention could also be utilized on other yarn processing machines. Further, a full illustration and description of the entire two-for-one twister yarn processing machine is not given herein and is not believed necessary for an understanding of the present invention, the operation and structure of such a two-for-one yarn twister being well understood by those with ordinary skill in the art.

Referring now to all three embodiments of the present invention, there is shown spindle assemblies, generally indicated at 10, and which are generally of the same construction for all three embodiments and which will be described and designated by like reference numerals. Each of the spindle assemblies 10, which are conventionally mounted in side-by-side relationship in a two-for-one yarn twister comprises a rotatably driven rotor mechanism, generally indicated at 11. The rotor mechanism 11 comprises a whorl 12 suitably rotatably mounted on the twister frame 13 and rotated by a continuous drive belt 14. The rotor mechanism 11 further includes a horizontally extending reserve disc device 16 secured to the whorl 12 for being driven thereby and a generally vertically extending hollow axle 17 defining a vertically extending yarn passageway 20.

Each spindle assembly 10 further includes a carrier mechanism 25 for carrying a hollow package P of yarn Y and being rotatably mounted on the rotor mechanism 11 so that the rotor mechanism may rotate relative thereto. The carrier mechanism 25 comprises generally a basket device 26 which surrounds the package P of yarn Y and is rotatably mounted by bearings 27 so that the hollow axle 17 may rotate relative thereto. The carrier mechanism 25 may further include a hollow yarn package carrier 28 rotatably mounted by suitable bearings, so that the hollow axle 17 may rotate relative thereto, and supported on the basket device 26. The hollow yarn carrier 28 may include a yarn entry tube 30.

The spindle assembly 10 further includes a balloon limitor device 33 surrounding the basket device 26. A yarn guide eyelet 40 is positioned above and in axial alignment with the hollow axle 17 and the yarn entry tube 30. There is further provided a pre-take-up roll 42, a yarn traversing mechanism 43, and a package roll 44 upon which the yarn Y is wound after being processed or twisted by the spindle assembly 10. The package roll 44 is rotated by a friction drive roll 45.

The twister may also include a suitable housing, generally indicated at 65, surrounding the front and rear and extending between each spindle assembly 10 and generally around the balloon limitor devices 33. These housings 65 may also include suitable shields 66 extending between each balloon limitor device 33.

With the above described mechanism, the yarn Y passes from the passage P and is threaded through the yarn entry tube 30, through the yarn passageway 20 of the hollow axle 17 and the reserve disc 16 and out of the reserve disc 16. The yarn Y then passes upwardly between the basket device 26 and the balloon limitor 33 to form a balloon of yarn. The yarn Y is then threaded through the yarn guide eyelet 40, over pre-take-up roll 42 and is traversed by traversing mechanism 43 onto the package roll 44 to complete its travel through the spindle assembly 10. As is well understood by those with ordinary skill in the art, a two-for-one twist is inserted in the yarn during the above noted path of travel.

Each of the spindle assemblies 10 include control means operatively connected therewith for selectively stopping and starting operation of the respective spindle assemblies. These control means may be in the form of devices for stopping rotation of the spindle assembly and for positioning the spindle assembly in the desired threading position, as set forth in U.S. Pat. No. 3,805,507, issued Apr. 23, 1974, and devices for stopping and controlling operation of the friction drive roll 45 in accordance with U.S. Pat. No. 3,565,356, issued Feb. 23, 1971, both of which are assigned to the assignee of the present invention. The control mechanisms of both of these prior U.S. patents include, inter alia, electrical and mechanical control systems for stopping operation of the spindle assembly and the spindle assembly and the take-up mechanism in predetermined positions when piecing or knotting broken yarns or doffing and starting up is required. Complete details of these control mechanisms are not illustrated in the description of the three embodiments of the present invention and are not believed to be necessary for a complete understanding of the present invention, reference being made to the above two prior U.S. patents of the assignee of the present invention for a complete understanding of these control means.

If during the travel of the yarn, as noted above, the yarn Y breaks or a new supply package P of yarn Y is placed in the spindle assembly 10, two separated ends of yarn Y are formed which must be knotted or pieced together for continued operation of the spindle assembly 10. When the yarn Y passing through a spindle assembly 10 is thus broken or otherwise separated, the separated ends are so positioned that one separated end extends downwardly from the eyelet 40 and the other separated end of yarn Y extends upwardly from between the basket device 26 and the balloon limitor device 33. Conventionally, a portable, manually operated knotter mechanism would be brought into position for receiving the two separated ends of yarn Y and knotting them together.

Referring now to the first embodiment of this invention, illustrated in FIGS. 1–3, there are provided holder devices, generally indicated at 70, mounted stationary on the housing 65 of the twister in front of each spindle assembly, as shown particularly in FIG. 1, for releasably mounting a portable, manually operated, knotter mechanism 60 at the desired knotting location in front of the spindle assemblies 10 for knotting operations. The yarn knotter mechanism 60 is of conventional, commercially available design and its operation for knotting two separated ends of yarn is well understood by those with ordinary skill in the art and does not require detailed explanation herein for an understanding of the present invention. Also, the arrangement of knotter mechanism 60 and the holder mechanism 70 of this embodiment of FIGS. 1-3 are set forth in the above mentioned U.S. patent application Ser. No. 376,742, filed July 5, 1973, and assigned to the assignee of the present invention and full details of the construction and operation thereof may be had by reference to this patent application.

Generally, the holder mechanism 70 comprises a generally rectangular, hollow, female receptacle 71, having an aperture 72 extending from the upper end thereof to the bottom end thereof, and mounted on the housing 65. For cooperation with the female receptacle 71, the yarn knotter mechanism 60 is provided with a male member 74 in the form of an angled outwardly extending arm which is secured at one end to the knotter mechanism 60 and which has an outer free end for extension into and reception by the female receptacle 71. Thus, as may be seen particularly in FIGS. 1 and 2, the yarn knotter mechanism 60 is positioned at the desired or convenient knotting location in front of the selected spindle assembly 10 when the yarn Y is broken or otherwise separated and requires piecing together or knotting.

As mentioned above, the knotting mechanism 60 is of a conventional, commercially available design for receiving two separated ends of yarn Y and for knotting them together. Broadly, the yarn Y coming from the supply package P and up between the basket device 26 and the balloon limitor device 33 is grasped by the operator and inserted into slit 78 of the knotter mechanism 60. The other separated yarn end Y extending down from the take-up roll is grasped by the operator and looped about a swingable hook 79 located on the back or inside of the knotter mechanism 60 (see FIG. 2) and is then inserted into slit 80 of the knotter mechanism 60. The two yarn ends are not ready for knotting by the knotter mechanism 60 and they may be held taut or under tension by the operator while the operator pushes a manually operatable, operating device 81 of the knotter mechanism 60 for effecting knotting of the two separated yarn ends in a manner well understood by those with ordinary skill in the art. The knotted or pieced together yarn may now be removed from the knotter mechanism 60 and normal yarn processing of the spindle assembly 10 resumed.

As disclosed in the above U.S. pat application Ser. No. 376,742, the holder mechanism 70 preferably includes an actuating means 95 in the form of a mechanical or electrical actuator and, as herein illustrated and described, comprises a switch controlled by a vertically directed, upwardly biased plunger member 96 which is positioned below the passageway or aperture 72 in the female receptacle 71 for engagement and depressing by the male member 74 of the knotter mechanism 60 when it is positioned in the holder 70. The plunger 86 will move back to its original position when the male member 74 of the knotter mechanism is removed from the female receptacle 71 of the holder mechanism 70.

The actuating switch 95 is operatively patent with the respective control mechanisms of the above identified U.S. Pat. Nos. 3,805,507 and 3,565,356 and is responsive to reception and mounting of the yarn knotter mechanism 60 in the holder member 70 for actuating those control mechanisms to stop operation of the respective spindle assembly 10 for a knotting operation and is responsive to removal of the yarn knotter mechanism 60 from the respective holder member 70 for actuating those control mechanisms to start operation of the respective spindle for yarn processing operations.

In accordance with the present invention and to reduce lost operating time due to yarn separation which is occasioned by the delay following a yarn knotting operation and removal of the knotting mechanism 60 from the holder 70 for actuating the actuator switch 95 to actuate the control mechanisms for starting operation of the respective spindle assembly 10, there is provided means operatively connected with and responsive to actuation of the operating device 81 of the knotter mechanism 60 for disengaging the plunger member 96 of the switch mechanism 95 from the male member 74 of the knotter mechanism 60 for actuating the control mechanisms to start operation of the spindle assembly 10 for the processing of yarn.

This means comprises a plunger member 96 in the form of a two-piece plunger **96*a*, 96*b* being pivotally mounted at 98 to each other. This improved means further includes an extension 81*a* of the manually pushable operating device 81 of the knotter mechanism 60 which extends outwardly from the other side of the knotter mechanism 60, so that when the operating device 81 is pushed by an operator for actuating the knotter mechanism 60, the extension 81*a* will engage the member 96*a* of the plunger 96 and pivot the same way from engagement by the male member 74 of the knotter mechanism 60 so that the plunger mechanism 96 will rise under the influence of its bias to place the switch mechanism 95 in the spindle start condition for actuating the control mechanisms of the spindle assembly for starting operation thereof. The delay in start-up of operation of the spindle assembly 10 in response to actuation of the control mechanisms thereof to the spindle start position will equal the time required for performing a knotting operation by the knotter mechanism 60**. Accordingly, no lost operating time after the knotting operation has been completed will be incurred by this operation.

Referring now to the second embodiment of this invention, as illustrated in FIGS. 4–6, spindle assemblies 10, of the above described construction, are also mounted in side-by-side position along a two-for-one twister yarn processing machine in the manner described above. In accordance with above mentioned U.S. Pat. No. 3,820,315, issued June 28, 1974, and assigned to the assignee of the present invention, each spindle assembly 10 includes a holder device 170 mounted stationary on the housing 65 of the twister in front of each spindle assembly 10, as shown particularly in FIG. 4, for releasably receiving and mounting a similar yarn knotter mechanism 60 at the desired knotting location in front of the spindle assembly 10 and generally at the top of the balloon restraining device 33 for knotting operation.

The yarn knotter mechanism 60 of this second embodiment of FIGS. 3–5 is generally of the same construction as the yarn knotter mechanism 60 of the first embodiment of this invention of FIGS. 1–3, except that the knotter mechanism 60 of this embodiment of FIGS. 4–6 further includes a hood member 194 mounted generally around and over the top portion of the knotter mechanism 60 and defines a passageway therethrough, for purposes to be described below, and an open mouth portion 196 extending over the top of the knotter mechanism 60 for receiving the broken or otherwise separated yarn ends. Further details of this hood construction may be had by reference to the above mentioned U.S. Pat. No. 3,820,315 and form no part of the present invention.

The holder devices 170 of this embodiment comprise a common generally horizontally extending conduit 172 carried by generally U-shaped yoke members 173 which are carried by the housing 65 of the twister. The conduit 172 extends along the front of each spindle assembly 10 and is connected with a suitable source of suction to create a negative air stream therethrough. The holder device 170 further includes a hollow female receptacle 175 secured to the top of the conduit 172 and forming a passageway 176 therein having open bottom and top ends. The bottom end of each of the passageways 176 of the female receptacles 175 mates with apertures in the top of the conduit 172 so that a negative air stream or suction is created through the passageways 176.

The open end of the passageway 176 of the female receptacle 175 is normally closed by a pair of pivoted, biased closure members 178. Each of the closure members 178 comprises an arm 179 pivoted at 180 on the female receptacle 175 and has an enlarged portion 181 on the other end thereof which mates with the enlarged portion 181 on the other closure member 178 to close the upper end of the passageway 176 of the female receptacle 175. The closure members 178 are biased in the closed position by an extension 182 of the arm 179 being in contact with a spring plunger member 184 carried in a recess in yoke member 173 for biasing the closure members 178 into mating covering position over the passageway 176.

For cooperating with the female receptacle 175, the knotter mechanism 60 of this embodiment of FIGS. 4–6 further includes a hollow male member 190 forming a portion of or an extension of the hood 95 around the knotter mechanism 60 and extends below the knotter mechanism 60. The male member 190 includes internally thereof a passageway having an open bottom and top and is configured and constructed for reception by and within the passageway 176 of the female receptacle 175 for mounting the knotter mechanism 60 in the respective holder means 170 and for placing the bottom end of the knotter mechanism passageway in mating communication with the female receptacle passageway 176 for creating a negative air flow through the male member 190 and through the hood portion 194.

Accordingly, as further described in the above-identified U.S. Pat. No. 3,820,315, when the yarn Y becomes broken or otherwise separated at a particular spindle assembly station 10, the separated ends of yarn Y will be placed at the opening 196 to the hood portion 194 of the knotter mechanism 60 and will be sucked therein and threaded through the knotter mechanism 60 by action of the suction conduits, described above, for automatic threading of the knotter mechanism 60. The knotter mechanism 60 is then actuated by a manually pushable operating device 81, as described above in connection with the knotting mechanism 60 of the first embodiment of this invention in FIGS. 1–3.

The holder mechanism 170 further includes actuating means 210 suitably operatively connected with the spindle assembly control means, described above and in prior U.S. Pat. Nos. 3,805,507 and 3,565,356. The actuating means 210 may be in the form of a biased push button switch 211 which is engaged by an extension rod 212 of one of the spring plunger members 184 so that when the respective closure member 178 is opened, the rod 212 will engage the switch 211 for actuating the control mechanisms of the respective spindle assembly 10 to stop operation thereof.

In accordance with the present invention and to reduce lost operating time due to yarn separation which is occasioned by the lost time required to remove the knotting mechanism 60 from the holder 170 for purposes of allowing the switch 211 to be disengaged by the rod 212 so that the actuating mechanism 210 may be switched to the spindle start position, there is provided means operatively connected and responsive to actuation of the knotter mechanism operating device 81 for disengaging the rod 212 and the push button switch 211 for allowing the switch 211 to be moved to the spindle start position thereof for allowing the control mechanisms of the spindle assembly 10 to start operation thereof.

In this second embodiment of FIGS. 4–6, this means comprises mounting of the push button switch 211 on a bracket 215 which is pivotally mounted about a spring biased stub shaft 216 so as to be swingable against the bias of the spring of the shaft 216 out of contact with the rod 212 of the plunger mechanism 184. This is accomplished by a lever arm 218 pivotally mounted about the pivot 180 and having an upper portion thereof for engagement by the extension 81*a* of the knotter mechanism operating member 81 and the lower end thereof connected to the bracket 215 at a pivot 220 so that when the knotter operating member 81 is manually pushed by an operator, the extension 81*a* will move the lever 218 to pivot the bracket 215 and switch 211 out of engagement with the rod 212 so that the switch 211 may be moved to its spindle start position for starting operation of the spindle assembly 10. The delay in start-up of operation of the spindle assembly 10 in response to actuation of the control mechanisms thereof to the spindle start position will equal the time required for performing a knotting operation by the knotter mechanism 60. Accordingly, no lost operation time after the knotting operation has been completed will be incurred by this operation.

Referring now to the third embodiment of this invention, as illustrated in FIGS. 7–9, there are also provided spindle assemblies 10, of the same general construction as described above with respect to the first two embodiments of this invention, which are also mounted in side-by-side position (not shown) along a two-for-one twister yarn processing machine. In this embodiment, carriage means, generally indicated at 300, is movably mounted on the yarn processing machine in front of the spindle assemblies 10 and carries the yarn knotter mechanism 60, of the same general, conventional and commercially available design as discussed above with respect to the first two embodiments of this invention, for positioning the knotter mechanism 60 at the desired knotting location in front of a selected spindle assembly 10 for a yarn knotting operation when the spindle assembly 10 is stopped by the control mechanism thereof in accordance with the above mentioned U.S. Pat. Nos. 3,805,507 and 3,565,356. For operating said control means, a yarn feeler device 302 is provided which will sense a broken or otherwise separated yarn Y and actuate the spindle control mechanisms for stopping operation thereof. Such a yarn feeler device may also be utilized in conjunction with the first two embodiments of this invention, described above.

In U.S. Pat. No. 3,842,577, issued Oct. 22, 1974, and assigned to the assignee of the present invention, a service carriage mechanism for carrying a yarn knotter mechanism is disclosed and described therein and reference may be had thereto for complete details of the construction and operation of the service carriage mechanism 300 shown herein. Broadly, the carriage mechanism 300 is supported by wheels 304 on a longitudinally extending rail 305 carried by the yarn processing machine. The carriage 300 is further supported by a U-shaped frame member 306 into which a guiding member 307 extends from the carriage 300. Thus, the carriage mechanism 300 and the yarn knotter mechanism 60 supported thereon are mounted for longitudinal movement along the front of the spindle assemblies 10 of the yarn processing machine for being positioned at a selected spindle assembly 10 for knotting together of the broken or otherwise separated yarn Y, as discussed above.

For mounting the knotter mechanism 60 on the carriage mechanism 300, the carriage mechanism 300 includes an upstanding portion 310 which includes ribs 311 on the upper end thereof which run generally horizontally and project outwardly on the inside and outside of the upstanding portion 310, as shown particularly in FIGS. 8 and 9. The knotter mechanism 60 includes a generally U-shaped bracket 315 secured to the bottom thereof and extending downwardly from the knotter mechanism 60 for being pushed over the ribs 311 of the upstanding portion 310 of the carriage mechanism 300. One side of the U-shaped bracket 315 includes a spring biased plunger mechanism 316 having an inwardly projecting portion for fitting under the outwardly extending rib 311 for maintaining the knotter mechanism in position on the upstanding portion 310 of the carriage mechanism 300, while allowing removal of the knotter mechanism 60 from the carriage mechanism 300 by manually pulling the plunger mechanism 316 outwardly to release its engagement with the rib 311 so that the knotter mechanism 60 may be manually removed from the carriage mechanism 300.

The knotter mechanism 60 of this third embodiment of FIGS. 7–9 may be manually operated by an operating device, as described above in conjunction with the first two embodiments of this invention, or may be driven by a pulley and drive belt arrangement connected to a drive shaft 320, as disclosed and described in U.S. Pat. No. 3,838,875, issued Oct. 1, 1974, and assigned to the assignee of the present invention. The specific details of this drive mechanism do not form part of the present invention and will not be described herein and reference may be had to the above noted patent for a full disclosure thereof.

In accordance with the present invention, means are operatively connected with the operating means of the knotter mechanism 60 and with the spindle stopping and starting control means and are responsive to actuation of the operating means of the knotter mechanism for actuating the control means to start operation of the spindle assembly for the processing of yarn Y, thereby reducing lost operating time due to yarn separation.

In accordance with this third embodiment of the present invention, this improved actuating means may be in the form of a biased push button switch 330 mounted in the upstanding portion 301 of the carriage mechanism 300 and a tripping pin 331 also suitably carried by the upstanding portion 310 of the carriage mechanism 300 and having a spring 332 therearound for biasing thereof in an upwardly extending position so that when the tripping pin 331 is pushed down against its bias it will engage the switch 330 for actuating the control mechanisms of the spindle assembly 10 to start operation thereof after a knotting operation.

Cooperating with the tripping pin 331 is a plunger device 335 carried by the knotting mechanism 60 and operatively connected with the operating shaft 320 thereof so that when the operating shaft 320 is rotated for actuating the knotter mechanism 60, the plunger 335 will be depressed to engage the spring biased tripping pin 331 to push the pin downwardly for engagement with the switch 330 for actuating the spindle stopping and starting control mechanisms to start operation of the spindle assembly 10.

Thus, when a particular spindle asembly 10 of the yarn processing machine has a broken or otherwise separated yarn end, the yarn feeler 302 will sense this broken end and stop operation of the spindle assembly 10 for a knotting operation. The knotting mechanism 60 will be brought into location in front of this spindle assembly 10 by the carriage mechanism 300 and the separated yarn ends will be inserted into the knotter mechanism 60 in the manner described above. The knotting mechanism 60 will then be operated by the operating means thereof through a suitable driver for the operating shaft 320. This operation of the knotting mechanism 60 will cause the plunger 335 to be depressed which will depress the tripping pin 331 and engaging the switch 330 which is operatively connected with the spindle assembly starting and stopping control mechanisms for actuating these control mechanisms to the spindle start condition thereof for again starting operation of the spindle assembly 10. The delay in start-up of the operation of the spindle assembly 10 in response to actuation of the control mechanisms thereof to the spindle start position will equal the time required for performing the knotting operation by the knotter mechanism 60. Accordingly, no lost operating time after the knotting operation has been completed will be incurred by this operation.

Therefore, this invention has provided a construction for reducing the lost operating time of a spindle assembly of a textile yarn processing machine following a knotting operation and before the spindle assembly can again be started up. Three specific preferred embodiments have been disclosed and it is apparent that features of each may be used in other general arrangements without departing from the present invention.

In the drawings and specification there have been set forth preferred embodiments of the invention and, although specific terms are employed, they are used in a generic and descriptive sense only and not for purposes of limitation.

What is claimed is:

1. In a textile yarn processing machine, such as a twister, spinning frame or the like, having a plurality of spindle assemblies positioned in side-by-side relationship thereon for processing of yarn, control means operatively connected with each of said spindle assemblies for selectively stopping and starting operation of said respective spindle assemblies, and a yarn knotter mechanism for being selectively positioned in front of each spindle assembly in the event of a broken or otherwise separated yarn therein for knotting together the two ends of the separated yarn when said spindle assembly is stopped by said control means and including selectively actuatable means for operating said knotter mechanism for the knotting operation; the improvement of means operatively connected with said operating means of said knotter mechanism and said spindle assembly stopping and starting control means and being responsive to actuation of said operating means of said knotter mechanism for actuating said control means to start operation of said spindle assembly for the processing of yarn, thereby reducing lost operating time due to the yarn separation.

2. In a textile yarn processing machine, such as a twister, spinning frame or the like, having a plurality of spindle assemblies positioned in side-by-side relationship thereon for processing of yarn, control means operatively connected with each of said spindle assemblies for selectively stopping and starting operation of said respective spindle assemblies, a yarn knotter mechanism for knotting together two ends of broken or otherwise separated yarn at selected spindle assembly locations in the event of a broken or otherwise separated yarn and including selectively actuatable means for operating said knotter mechanism for the knotting operation, holder means mounted on said yarn processing machine in front of each of said spindle assemblies for releasably receiving and mounting said yarn knotter mechanism at the desired knotting location in front of said selected spindle assemblies for a yarn knotting operation, and actuating means operatively connected with said respective control means and being responsive to reception and mounting of said yarn knotter mechanism in said respective holder means for actuating said control means to stop operation of said respective spindle assembly means for a yarn knotting operation; the improvement of:

means operatively connected with said operating means of said knotting mechanism and said spindle stopping and starting control means and being responsive to actuation of said operating means of said knotter mechanism for actuating said control means to start operation of said spindle assembly for the processing of yarn, thereby reducing lost operating time due to yarn separation.

3. In a textile yarn processing machine, such as a twister, spinning frame or the like, having a plurality of spindle assemblies positioned in side-by-side relationship thereon for processing of yarn, control means operatively connected with each of said spindle assemblies for selectively stopping and starting operation of said respective spindle assemblies, a yarn knotter mechanism for knotting together two ends of broken or otherwise separated yarn at selected spindle assembly locations in the event of a broken or otherwise separated yarn and including manually operated, selectively actuatable means for selectively operating said knotter mechanism for the knotting operation, holder means mounted on said yarn processing machine in front of each of said spindle assemblies for releasably receiving and mounting said yarn knotter mechanism at the desired knotting location in front of said selected spindle assemblies for a yarn knotting operation, and switch means carried by said holder means and operatively connected with said respective control means and switch actuating means carried by said holder means and responsive to reception and mounting of said yarn knotter mechanism in said respective holder means for engaging and actuating said switch means for actuating said control means to stop operation of said respective spindle assembly means for a yarn knotting operation; the improvement of:

means operatively connected to and being responsive to actuation of said operating means of said knotter mechanism for disengaging said switch actuating means and said switch means for actuating said control means to start operation of said spindle assembly for the processing of yarn, thereby reducing lost operating time due to yarn separation.

4. In a textile yarn processing machine, set forth in claim 3, in which said knotter mechanism includes a downwardly extending member extending into and downwardly through said holder means when said knotter mechanism is placed in said holder means, said switch actuating means comprises a medially pivoted, two-piece lever means connected at one end to said switch means and extending upwardly therefrom for being engaged and depressed by said downwardly extending member of said knotter mechanism when said knotter mechanism is placed in said holder means for actuating said switch means for actuating said spindle assembly control means to stop operation of said respective spindle assembly for a yarn knotting operation, and said means for disengaging said switch actuating means and said switch means comprises an extension member forming a part of said knotter mechanism operating means for engaging said lever means when said knotter mechanism operating means is actuated for moving said lever means out of engagement with said downwardly extending portion of said knotter mechanism for actuating said switch means to the spindle start condition thereof for actuating said spindle assembly control means to start operation of said spindle assembly for the processing of yarn.

5. In a textile yarn processing machine, as set forth in claim 3, in which said holder means includes swingable arm means swingable from a closed position to an open position when said knotter mechanism is inserted into said holder means, said switch actuating means comprises plunger means carried by said holder means and positioned for engagement by said swingable arm means for contacting said switch means when said swingable arm means is in the open position thereof to actuate said switch means for actuating said spindle assembly control means to stop operation of said respective spindle assembly, and said means for disengaging said switch actuating means and said switch comprises means mounting said switch means for pivotal swinging movement out of engagement with said plunger means, and lever arm means carried by said holder means and having one end thereof secured to said switch means for effecting pivotal movement thereof, and an extension member forming a part of said knotter mechanism operating means for movement when said knotter mechanism operating means is actuated for engaging said lever means for moving said lever means to swing said switch means out of engagement with said plunger means for actuating said switch means to the spindle start condition thereof for actuating said spindle assembly control means for starting operation of said spindle assembly for the processing of yarn.

6. In a textile yarn processing machine, such as a twister, spinning frame or the like, having a plurality of spindle assemblies positioned in side-by-side relationship thereon for processing of yarn, control means operatively connected with each of said spindle assemblies for selectively stopping and starting operation of said respective spindle assemblies, a yarn knotter mechanism for knotting together two ends of broken or otherwise separated yarn at selected spindle assembly locations in the event of a broken or otherwise separated yarn and including selectively actuatable means for operating said knotter mechanism for the knotting operation, and carriage means movably mounted on said yarn processing machine in front of said spindle assemblies and carrying said yarn knotter mechanism for positioning said knotter mechanism at the desired knotting location in front of said selected spindle assembly for a yarn knotting operation when said spindle assembly is stopped by said control means; the improvement of:

means operatively connected with said operating means of said knotting mechanism and said spindle assembly stopping and starting control means and being responsive to actuation of said operating means of said knotter mechanism for actuating said control means to start operation of said spindle assembly for the processing of yarn, thereby reducing lost operating time due to yarn separation.

7. In a textile yarn processing machine, as set forth in claim 6, in which said means operatively connected when said operating means of said knotter mechanism and said spindle assembly stopping and starting control means comprises.

switch means carried by said carriage mechanism and operatively connected with said spindle assembly control means, and plunger means connected with said knotter mechanism operating means and operatively associated with said switch means for actuating said switch means when said knotter mechanism operating means is actuated for actuating said spindle assembly control means for starting operation of said spindle assembly for the processing of yarn.

* * * * *

UNITED STATES PATENT AND TRADEMARK OFFICE

CERTIFICATE OF CORRECTION

PATENT NO. : 3,939,633

DATED : February 24, 1976

INVENTOR(S) : Willy Heimes

It is certified that error appears in the above-identified patent and that said Letters Patent are hereby corrected as shown below:

Column 2, line 7, "mechanism" should be --mechanisms--;
Column 2, line 11, "SUMMAY" should be --SUMMARY--;
Column 2, line 34, "knotter" should be --knotting--;
Column 4, line 12, "mechanism" should be --mechanisms--;
Column 4, line 13, "passage" should be --package--;
Column 4, line 40, delete --and the spindle--;
Column 4, line 41, delete --assembly--;
Column 5, line 48, "not" should be --now--;
Column 5, line 58, "pat" should be --patent--;
Column 5, line 67, "86" should be --96--;
Column 6, line 3, "patent" should be --connected--;
Column 10, line 8, "301" should be --310--;
Column 10, line 37, "driver" should be --drive--;
Column 12, line 63, after "switch" insert --means--;
Column 14, line 14, "when" should be --with--.

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*